US005412895A

United States Patent [19]

Krieger

[11] Patent Number: 5,412,895

[45] Date of Patent: May 9, 1995

[54] FLOATING GUN BARREL MOUNT

[76] Inventor: John M. Krieger, W. 509 Hwy. 0, Hartford, Wis. 53027

[21] Appl. No.: 28,432

[22] Filed: Mar. 9, 1993

[51] Int. Cl.[6] ..... F41A 21/48

[52] U.S. Cl. ..... 42/75.02; 89/14.05

[58] Field of Search ..... 42/75.02, 75.01, 76.01, 42/75.03, 75.04; 89/14.05

[56] References Cited

U.S. PATENT DOCUMENTS

| | | | |
|---|---|---|---|
| 384,277 | 6/1988 | Pope | 42/75.02 |
| 529,455 | 11/1894 | Mavlin | 42/75.02 |
| 1,065,341 | 6/1913 | Browning | 42/75.02 |
| 1,172,714 | 2/1916 | Johnson | 42/75.02 |
| 1,628,798 | 5/1927 | Nelson | 42/75.02 |
| 1,696,537 | 12/1928 | Kewish | 42/75.02 |
| 1,864,374 | 6/1932 | Romberg et al. | 42/76.01 |
| 2,736,117 | 2/1956 | Clarkson et al. | 42/75.02 |
| 2,736,118 | 2/1956 | Clarkson et al. | 42/75.02 |
| 3,842,527 | 10/1974 | Low | 42/76.01 |
| 3,877,167 | 4/1975 | Keppeler | 42/75.02 |
| 4,674,217 | 6/1987 | Matievich | 42/76.01 |
| 4,920,679 | 5/1990 | Savles et al. | 42/75.02 |

FOREIGN PATENT DOCUMENTS

| | | | |
|---|---|---|---|
| 157515 | 10/1985 | European Pat. Off. | 42/75.01 |
| 1050325 | 1/1954 | France | 42/69.02 |
| 124591 | 4/1949 | Sweden | 42/75.02 |
| 703188 | 1/1954 | United Kingdom | 42/75.01 |

*Primary Examiner*—Stephen M. Johnson
*Attorney, Agent, or Firm*—Wheeler & Kromholz

[57] ABSTRACT

A floating gun barrel mount having the barrel free to remain straight and free of deflection by the sling because it is not attached to the forearm, and a two piece barrel nut to allow universal alignment of gas tube openings. The two piece barrel nut allows for mass production of the barrel nut, allows alignment for any rotational position of the threads on the barrel receiver, and still provides the high amount of pressure required to secure the barrel firmly to the receiver.

1 Claim, 1 Drawing Sheet

FLOATING GUN BARREL MOUNT

BACKGROUND OF THE INVENTION

This invention relates generally to the field of firearms and specifically to the field of gun barrels for automatic and semiautomatic firearms.

A gun barrel is a very high precision part which guides the bullet until it leaves the barrel. In order for a barrel to perform to its full accuracy it must be allowed to vibrate freely and be unaffected by outside forces, such as sling tension.

On the outside of a normal gun barrel near the firing mechanism is a circular shoulder which is used to pull the gun barrel into tight engagement with the receiver that receives the gun barrel, and other parts. Typically, a nut, that has a shoulder matching the rib of the gun barrel, is used to hold and adjust the gun barrel so that when the nut is tightened the gun barrel is pulled into position and held there. There is also a gas tube which starts at the outer tip of the gun barrel and carries the expanding gas from the exploding gun powder back to the operating mechanism of the gun to work a piston to open the bolt, throw out the used cartridge, pick up a new cartridge, and close the bolt again. This feature permits automatic firing. The gas tube is kept very close to the barrel and actually passes through the nut which holds the barrel in place. Unfortunately, the threads on the receiver, on which the nut turns, can start at any rotational position. For that reason the hole in the nut for the gas tube cannot be aligned with any certainty unless it is drilled separately for each gun. Machining for an accessory rail used in target shooting or sling swivel must also be done individually for each gun. The alternative is to provide a series of holes all the way around the nut and line one of them up. Neither is a very good solution, particularly since it may be necessary to back off the nut slightly from its full tight position to line up a hole for the gas tube.

A second problem with the way guns are currently constructed is that the mounting for the end of the sling, by which the gun is carried and steadied to fire, is on the outer end of the gun barrel. That means that when the gun is being fired, the tension of the sling which is used to steady the gun also tends to bend the barrel slightly in the direction of the force on the sling. Since the force on the sling is in different directions, depending on whether the gun is being fired from a standing position, a sitting position, or a prone position, the gun barrel will bend in different directions and throw the accuracy off in different ways for the different positions. In any case, the gun barrel should not bend but should be totally straight and allowed to vibrate freely.

The device of my invention overcomes these problems by virtue of its unique and simple design. I am aware of no prior art device which performs the function of my proposed invention.

For example U.S. Pat. No. 3,877,167 (Keppeler) shows neither a gas tube nor any part that needs to be aligned in the way that a gas tube must be aligned. However, a gun barrel with two separate nuts is shown. Referring to reference character 3 of the patent it may be seen that a breach with threads to receive a gun barrel is shown. Also shown is a keyway for receiving pin 9 in the receiver. The extent to which the gun barrel is screwed into the breach is not critical so it could be rotationally adjusted to the correct position after which nut 10 could be screwed into the receiver to force breach 5 into engagement with receiver 8. There is no disclosure suggesting that this patent function in the manner of the present invention nor that it have the structure of the invention. In particular the gun barrel shown does not have a circular rib so the mode of action is different.

Other references include U.S. Pat. No. 1,065,341 (Browning), U.S. Pat. No. 1,628,798 (Nelson), U.S. Pat. No. 1,172,714 (Johnson), U.S. Pat. No. 2,736,117 (Clarkson) U.S. Pat. No. 2,763,118 (Clarkson), U.S. Pat. No. 4,674,217 (Matievich), U.S. Pat. No. 3,842,527 (Low), U.S. Pat. No. 4,920,679 (Sarles), and U.S. Pat. No. 529,455 (Marlin).

Summary of the Invention

Instead of rigidly mounting the outer end of the gun barrel in a wooden, steel, or composite "forearm", or handgrip, the barrel is made free at the outer end to "float" and the sling is attached to the forearm structure around the gun barrel rather than the gun barrel itself. Since that structure does not pull on the gun barrel, there is no distortion introduced.

Second, with regard to the problem of securing the nut in proper position, the barrel nut is divided into two parts. A first portion of the barrel nut goes on the receiver of the gun and has threads that engage the original threads of the receiver but because this first portion has nothing to engage the rib on the barrel it does not matter how far the first portion must be turned to line up with the gas tube. Consequently, the rotational position of the threads on the second portion is no longer significant. The first portion is simply screwed on the appropriate distance in order to both engage a sufficient number of threads and to line up the holes for the gas tube. Then the second portion of the nut is screwed into the inside of the first portion of the nut on the same threads that attach the first portion to the receiver until the collar on the barrel of the gun is clamped securely between the first portion, the receiver, and the second portion (the outer part of the barrel nut). Now, instead of custom fitting each barrel nut for the particular gun, it is possible to have a mass production part which may be used on any such gun and which will always allow the holes for the gas tube to be lined up perfectly while putting the desired high amount of pressure on the rib of the gun barrel to secure it firmly.

Alternatively, the first portion of the nut may be machined so that it is so thin radially that it does not interfere with the gas tube (or in the alternative it may be provided with an opening or a series of openings for the gas tube). One end of the first portion of the barrel nut has a right handed thread and fits with the receiver of the gun but does not touch the rib or collar on the barrel. The second portion of the barrel nut screws into the first portion as before but it is provided with left handed threads. This portion of the nut is screwed down firmly inside the first portion to engage the rib or collar on the barrel. The combination of the right hand and left hand thread on the first portion of the barrel nut gives a very secure connection against vibration. Additionally, if it is needed to line up any gas tube hole in the first part it can be backed off as necessary and the second part of the nut can be tightened against it so that the barrel is very tightly held.

In another alternative, the first portion of the nut may have threads of a first pitch to match the receiver threads of the gun, and threads of a second pitch to match the threads of the second portion of the nut. Again the two threads are used to obtain proper alignment of the forearm.

Accordingly, the device of the present invention may be summarized as a floating gun barrel mount for a gun having a sling extending from the stock to the forward end of the gun, a receiver to receive a barrel, threads having a rotational position around a barrel receiving opening, a barrel having a rib to pull it tightly against the receiver, and a barrel nut to engage the rib of the barrel. The barrel nut being two pieces, a first piece that engages the threads of the receiver opening and a second piece that is threaded to the first piece that engages the rib of the barrel to secure it. Therefore, the rotational position of the threads around the receiver opening does not affect the ability to align the gas tube opening to receive the gas tube, and the barrel nut fits all said guns instead of requiring to be tailored to fit a single gun.

Further, the forward end of the gun barrel is surrounded by a forearm supported only by the receiver and separated from the gun barrel, and a sling has a forward end attached to the forearm so that the gun barrel will not experience bending forces from the sling. Alternatively, the first piece has left handed threads, where the first piece engages the second piece, and the second piece is threaded to the first piece by a left handed thread. Also, the first piece may have has an opening adapted to permit passage of a gas tube through the first piece on a path that is substantially parallel to the gun barrel. Finally, the opposite ends of first piece may have two sets of threads having a different pitch so that only one particular nut will fit on each particular end.

These and other benefits of the present invention will become apparent from the following detailed description thereof taken in conjunction with accompanying drawings.

Detailed Description

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The present invention is designed for use with an AR15/M16 type of rifle.

Figure 1:
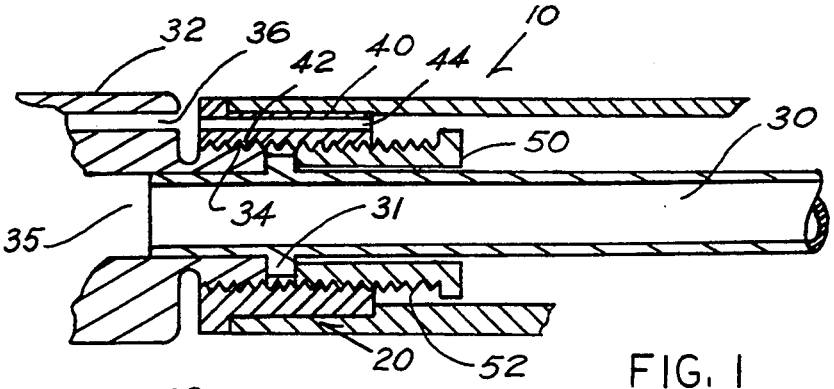
FIG. 1 illustrates a cross-sectional side view of the gun barrel showing the divided nut.
Figure 3:
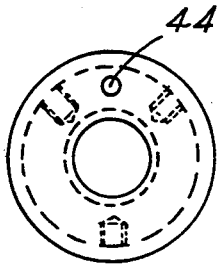
FIG. 3 is an endview of the first portion of the barrel nut shown in FIG. 1.
Figure 3A:
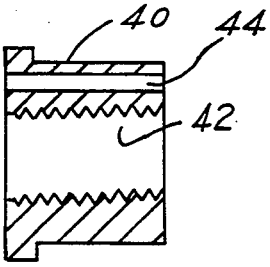
FIG. 3*a* is a cross-sectional side view of the first portion of the barrel nut shown in FIG. 1.

Referring to FIG. 1, the floating gun barrel mount 10 may be seen. The floating gun barrel mount 10 has a barrel nut 20 having a first portion 40 and a second portion 50. Referring also to FIG. 3 and its FIG. 3*a*, the first portion 40 may be seen to have internal threads 42 and an opening 44 for a gas tube. The receiver 32 has an opening 36 for the gas tube, a barrel receiving opening 35, and external receiver threads 34. The first portion 40 screws on to the receiver 32 by the engagement of the external receiver threads 34 and the internal threads 42. When the first portion 40 has engaged a sufficient number of the external receiver threads 34 to hold its position, its position is adjusted by slightly screwing or unscrewing the first portion 40 so that the openings 36 and 44 for the gas tube line up. Before or after the first portion 40 is screwed onto the external receiver threads 34, a barrel 30 is introduced into the barrel receiving opening 35. The barrel 30 has a barrel rib 31 which is used in combination with the barrel nut 20 to hold the barrel 30 to the receiver 32. The interaction between the barrel rib 31 and the barrel nut 20 will become evident in the following paragraph.

Figure 4:
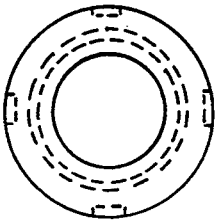
FIG. 4 is an endview of the second portion of the barrel nut shown in FIG. 1.
Figure 4A:
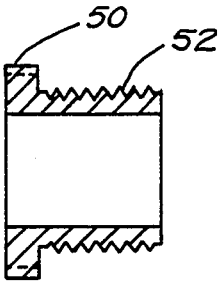
FIG. 4*a* is a cross-sectional side view of the second portion of the barrel nut shown in FIG. 1.
Figure 5:
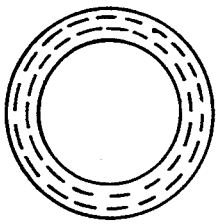
FIG. 5 is an endview of the first alternative portion of the barrel nut shown in FIG. 2.
Figure 5A:
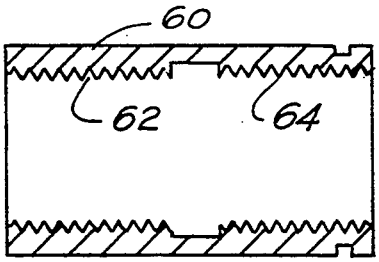
FIG. 5*a* is a cross-sectional side view of the first alternative portion of the barrel nut shown in FIG. 2.
Figure 6:
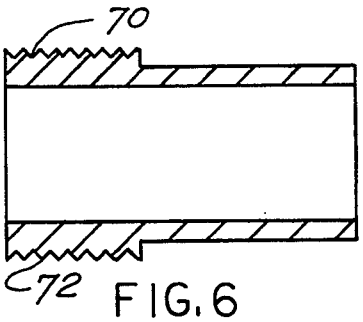
FIG. 6 is a cross-sectional side view of the alternative second portion of the barrel nut shown in FIG. 2.

Referring to FIG. 4, the second portion 50 may be seen to have external threads 52. When the first portion 40 has been screwed onto the receiver 32, the openings 36 and 44 for the gas tube have been aligned, and the barrel 30 introduced into the barrel receiver opening 35, the second portion 50 is screwed into the inside of the first portion 40 by the engagement of the external threads 52 and the internal threads 42. The second portion 50 is screwed into the inside of the first portion 40 until the engagement of the first portion 40 and the second portion 50 securely clamps the barrel 30 to the receiver 32 by the pressure of the second portion 50 against the barrel rib 31.

The unique use of the two-part barrel nut 20 allows each barrel nut 20 to be exactly the same. It is thus possible to have a mass production part which may be used on any receiver 32 with the appropriate size barrel 30 and external receiver threads 34. The previous problems with alignment of the gas tube openings 36 and 44 and positioning of accessory, such as sling swivels or the forearm 16, is no longer at issue in the present invention.

Figure 2:
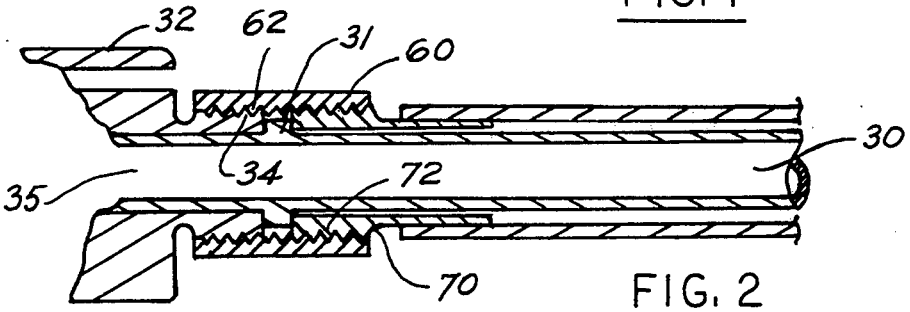
FIG. 2 discloses an alternative embodiment of the device shown in FIG. 1.

Referring to FIG. 2, an alternative embodiment of the floating gun barrel mount 10 may be seen. In the alternative embodiment, an alternative first portion 60 screws onto the external receiver threads 34 by the engagement of the external receiver threads 34 and a first set of internal threads 62. The first set of internal threads 62 and the external receiver threads 34 are right handed. The alternative first portion 60 may be machined so that it is so thin radially that it does not interfere with the gas tube. The alternative first portion 60 is screwed onto the receiver 32. The barrel 30 is introduced into the barrel receiver opening 35, and the alternative second portion 70 is screwed into the alternative first portion 60 as before. However, the second set of internal threads 64 of the alternative first portion 60 are left handed. The external threads 72 of the alternative second portion 70 are also left handed. The combination of right handed and left handed threads on the first portion 60 and second portion 70 of the barrel nut 20 provides a very good anti-vibration connection.

Figure 7:
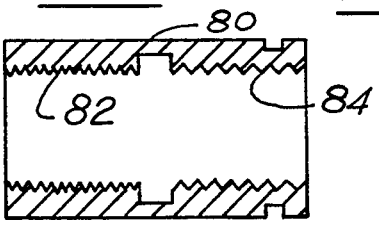
FIG. 7 is a cross-sectional side view of the second alternative portion of the barrel nut.
Figure 8:
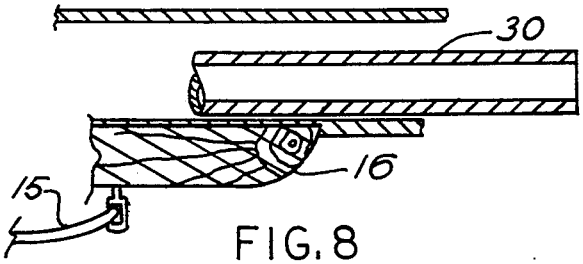
FIG. 8 is a cross-sectional side view of the barrel and forearm/sling configuration.

In yet another alternative embodiment, as shown in FIGS. 7 and 8, a second alternative first portion 80 may be seen to have a first set of internal threads of a first pitch 82 that engage external receiver threads 34 of the receiver 32. The second alternative first portion 80 would have a second set of internal threads of a second pitch 84 into which external threads 72 of the alternative second portion 70 would screw. The external threads 72 of the alternative second portion 70 can be either left handed or fight handed as long as the internal threads of second pitch 84 are the same. The alternative embodiments also serve to secure the barrel 30 to the receiver 32 by pressure against the barrel rib 31.

In each of its embodiments, the floating gun barrel mount 10 will allow connection of the barrel 30 to the receiver 32 no matter what rotational orientation the external receiver threads 34 have to the barrel receiving opening 35.

The left hand and the right hand threads, or the threads of different pitch, allow the forearm mounting tube, which has hand guards mounted to it, to be accurately aligned regardless of the rotational position at which each thread starts and ends.

Referring to FIG. 8, the barrel 30 may be seen in relation to a forearm 16 and a sling 15 attached to the forearm 16. The forearm 16 is secured to the receiver 32. The forearm 16 is not attached in any way to the barrel 30. Since the sling 15 is attached to the forearm 16, the sling 15 is not attached to the barrel 30 either. This arrangement frees the barrel 30 from tension due to the normal arrangement, in which the forearm 16 and the barrel 30 and the sling 15 would be connected. In my invention the sling 15 exerts no tension on the barrel 30. The barrel 30 is thus free to remain straight, allowing more accuracy in its firing since the sling 15 does not pull the barrel 30 out of alignment.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A floating gun barrel mount for a gun having a forward end, a sling and a stock, the sling extended from the stock away from the forward end of the gun, a receiver to receiver a barrel, threads having a rotational position around a barrel receiving opening, the barrel having a rib to pull the barrel tightly against the receiver, and a barrel nut to engage the rib of the barrel, the floating gun barrel mount comprising:

the barrel nut being two pieces, a first piece having opposite ends and two sets of threads, one of each of the sets of threads being located at the opposite ends, and each said set of threads having a different pitch;

one set of the threads of the first piece engaging the threads of the receiver opening;

a second piece engaging the second set of threads of the first piece and engaging the rib of the barrel to secure the barrel to the receiver.

* * * * *